US007287473B2

(12) United States Patent
Kleibaumhüter et al.

(10) Patent No.: US 7,287,473 B2
(45) Date of Patent: Oct. 30, 2007

(54) METHOD FOR SELECTING PRINTING MATERIAL IN A PRINTING PRESS AND PRINTING PRESS

(75) Inventors: Klaus-Dieter Kleibaumhüter, Bad Schönborn (DE); Helmut Meyer, Wiesloch (DE); Karlheinz Schmitt, Sandhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/638,613

(22) Filed: Dec. 13, 2006

(65) Prior Publication Data

US 2007/0144389 A1 Jun. 28, 2007

(30) Foreign Application Priority Data

Dec. 20, 2005 (DE) ..... 10 2005 060 889

(51) Int. Cl.
*B41F 33/00* (2006.01)

(52) U.S. Cl. ..... 101/483; 101/484

(58) Field of Classification Search ..... 101/483, 101/484

See application file for complete search history.

(56) References Cited

U.S. PATENT DOCUMENTS

| | | | | |
|---|---|---|---|---|
| 4,346,446 A | | 8/1982 | Erbstein et al. | |
| 5,337,587 A | | 8/1994 | Davidson | |
| 5,810,235 A | | 9/1998 | Hoynant et al. | |
| 5,865,120 A | * | 2/1999 | Gross | 101/483 |
| 5,927,201 A | | 7/1999 | Birkenfeld et al. | |
| 6,244,174 B1 | * | 6/2001 | Sirowitzki et al. | 101/212 |
| 2005/0028700 A1 | | 2/2005 | Hauck | |

FOREIGN PATENT DOCUMENTS

| | | |
|---|---|---|
| DE | 2 259 761 | 6/1974 |
| DE | 130 775 | 5/1978 |
| DE | 39 38 138 A1 | 5/1991 |
| DE | 42 42 259 A1 | 6/1994 |
| DE | 196 11 878 A1 | 11/1996 |
| DE | 198 32 453 A1 | 1/2000 |
| DE | 10 2004 033 056 A1 | 2/2004 |
| EP | 0 712 081 A1 | 5/1996 |
| EP | 0 860 276 A1 | 8/1998 |
| EP | 1 593 501 A2 | 11/2005 |

* cited by examiner

*Primary Examiner*—Minh Chau
(74) *Attorney, Agent, or Firm*—Laurence A. Greenberg; Werner H. Stemer; Ralph E. Locher

(57) ABSTRACT

An apparatus and a method for the selection of printing materials in a machine processing printing materials has at least one control computer. The operating data of the machine processing the printing materials is logged by the computer and a tolerance limit corresponding to the operating data registered is stored in the computer. When the tolerance limit is exceeded during a time interval, the printing materials produced in this time interval are registered in the control computer.

11 Claims, 2 Drawing Sheets

METHOD FOR SELECTING PRINTING MATERIAL IN A PRINTING PRESS AND PRINTING PRESS

CROSS-REFERENCE TO RELATED APPLICATION

This application claims the priority, under 35 U.S.C. §119, of German application DE 10 2005 060 889.2, filed Dec. 20, 2005; the prior application is herewith incorporated by reference in its entirety.

BACKGROUND OF THE INVENTION

Field of the Invention

The invention relates to a method for the selection of printing materials in a machine processing printing materials and having at least one control computer. The operating data of the machine processing printing materials is logged by the computer and a tolerance limit corresponding to the operating data registered is stored in the computer.

The operation of a printing press is all the more economic when the fewest unusable prints are produced. The unusable prints are designated rejects and arise in particular when starting up a printing press or after a job change, since here the entire printing press first has to be transferred to a stable operating state until the printing quality is constant. These phases should be as short as possible in a printing press, in order that few rejects are produced. However, even after the initial unstable phase, the printing method is not stable under all conditions because of the many external conditions which have an effect on the printing method. For example, temperature changes, increased atmospheric humidity, increasing wear on the printing press and similar effects have an effect on the printing operation and therefore the printing image on the printing materials produced. In the case of a sheetfed rotary printing press, the printed sheets produced are deposited on a stack in a deliverer. If the conditions change during the printing operation, there is the risk that, because of these fluctuations, sheets are produced which, although they are deposited on the deliverer stack, do not correspond to the requirements of the customer. It is therefore important that these printed sheets do not reach the customer.

German laid-open patent specification DE-OS 22 59 761 discloses an apparatus for registering and separating out rejects during the printing operation of a printing press. For this purpose, measuring devices which register the quality of the printing sheets and are thus able to distinguish reject sheets from good sheets are fitted in the printing press. One criterion for this can be, for example, the registration of register marks which are applied to the sheets for the in-register printing. If the register marks exceed a predefined register error, the corresponding sheets are recognized as rejects and appropriately removed from the printing press via a diverter by the reject recognition apparatus provided with a shift register.

Published, non-prosecuted German patent application DE 198 32 453 A1, corresponding to U.S. Pat. No. 6,244,174, discloses a maintenance and inspection system for a printing press which has a computer which is connected to sensors and is connected to signal generators belonging to the printing press. In this case, the computer registers the signals from the signal generators and the drive motors of the printing press and, from the signals, determines the state of consumable materials and the state of wear of the corresponding machine components. On the basis of the state determined, the time and scope of appropriate maintenance measures are then defined. This is intended to ensure that maintenance and inspection measures are carried out in good time before the operating state of the printing press deteriorates to such an extent that the rejects increase sharply during a printing operation. However, the maintenance and diagnostic system merely monitors the state of the printing press and, if necessary, outputs warning hints to the operator if maintenance is urgently required. In this case, however, sorting out reject sheets is not carried out.

SUMMARY OF THE INVENTION

It is accordingly an object of the invention to provide a method for selecting printing materials in a printing press and to a printing press that overcomes the above-mentioned disadvantages of the prior art devices and methods of this general type, which permits the most precise forecast possible of rejects that occur during a printing operation.

The method according to the invention is extremely well suited to making estimates relating to rejects to be expected in sheetfed offset printing presses. However, the method is not restricted to this application; for example it can also be used in digital printing presses or copiers. According to the present method, a machine processing the printing materials is equipped with a control computer which registers and logs the operating data from the machine. In addition, one or more tolerance limits corresponding to the operating data registered are stored in the control computer. The operating data of a printing press can be operating temperature, atmospheric humidity, inking unit temperature but also voltage fluctuations in the power supply of the printing press. In this case, the operating data registered is compared continuously with the stored tolerance limits; when one or more tolerance limits are exceeded during a specific time interval, the printing materials produced in this time interval are registered by the control computer. Therefore, in the event of deviations which are not to be tolerated occurring in operating data from the printing press, these deviations are assigned chronologically to the corresponding printed sheets in the printing press. The printing materials are then stored in the control computer of the printing press so that by using, for example, the counter reading of the printing press, the corresponding sheets can be found again at any time. Accordingly, operating states are assigned to printing materials in which predefined tolerance limits are exceeded.

In a first refinement of the invention, provision is made for disturbances occurring in the power supply of the machine processing printing materials to be registered in the control computer. Disturbances in the power supply can be in particular mains fluctuations but also short power failures. The mains fluctuation and power failures necessarily have an effect on the electric drive motors of the printing press. These in turn influence the printing operation since, as a result, the printing speed of the printing press likewise begins to fluctuate. A fluctuating printing speed always ensures an increased susceptibility to rejects, however, so that it is expedient to register those sheets during whose production time corresponding fluctuations have occurred in the power supply. If necessary, the sheets can then be removed separately and subjected to additional assessment by the printer.

In a further refinement of the invention, provision is made for the machine processing printing materials to be a printing press and for printing speed changes to be registered by the control computer. Not every fluctuation in the power supply must simultaneously necessarily lead to a change in the printing speed of the printing press, since the printing press represents a rather sluggish oscillatory system because of the high rotating masses. It is therefore expedient to register the printing speed of the machine additionally via sensors, so that the control computer knows whether a change in the printing speed has actually taken place because of any kind of disturbances and rejects accumulate in this way.

Furthermore, provision is made for the machine for processing the printing materials to be a printing press and for adjustment procedures in the inking unit of the printing press to be registered by the control computer. If adjustment procedures are carried out in an inking unit of the printing press, these necessarily have an effect on the printed image of the sheet currently being produced. This can still be disregarded in the case of small control interventions but not in the case of larger control interventions. Adjustment procedures in the inking unit of a printing press are in particular changes in the openings of inking zone slides in the ink fountain. Using these inking zone slides, ink metering and therefore the application of ink to the printing material is controlled. For a uniformly constant printing quality, a uniform application of ink is necessary, which can be influenced detrimentally by adjustment procedures in the inking unit. By the present invention, it is possible to register those sheets during whose production these adjustment procedures were carried out in the inking unit. These sheets can likewise be subjected to additional assessment by the printer or separated out by the latter.

Advantageously, provision is additionally made for the operating data registered to be evaluated and assessed by using predefined assessment principles stored in the control computer. The operating data of a printing press is first stored separately in the control computer. In this case, it is possible to provide a separate tolerance limit for each type of operating data, in order to measure the operating data on this tolerance limit. Alternatively, however, the operating data can also first be registered and assessed in its entirety and the result of the assessment can then be compared with the predefined overall tolerance limit. In this case, and also in the first case, individual operating data can be assigned different weights, so that exceeding can be permitted in the case of some operating data while, in the case of other critical operating data, this is weighted more highly in the result of the assessment. This assessment and weighting is carried out by using mathematical models which are deposited in the control computer in the form of software. At the end of the assessment, however, there is always a statement as to whether the associated printing material has exceeded one or more permissible tolerance limits and, if appropriate, is registered by the control computer as rejects.

Provision is advantageously made for the printing materials produced and registered to be removed from the machine processing the printing materials by a sheet diverter. Since the sheets in which there is a suspicion of rejects are in each case registered by the control computer, the removal of the registered printing materials by a sheet diverter can be implemented relatively simply. Each sheet is assigned a counter reading, so that the sheet is registered appropriately, at least in the control computer. By using the passage speed induced by the printing speed, a sheet diverter fitted at the end of the printing press can then be given a signal that the corresponding printing material is not to be deposited on the deliverer stack but is to be removed by a sheet diverter.

Provision can additionally be made for the sheets removed to be deposited on a rejects stack. In this case, in addition to the deliverer stack having the good sheets, an additional rejects stack is created, which is supplied with reject sheets via the sheet diverter and a rejects deliverer.

Furthermore, provision can be made for the sheet printing materials produced and registered by the control computer to be provided with a marking. For this purpose, a marking unit, which is operatively connected to the control computer, is fitted in the printing press. Each sheet which is designated as suspected of being a reject by the control computer is provided with an appropriate marking by the marking unit. This can be imprints or else a marking by punching or perforation, so that reject sheets can be detected visually as such by the printer at any time.

In an alternative refinement of the invention, provision is made for the sheet printing materials registered by the control computer to be separated from further sheet printing materials by a tab inserter. It is therefore possible to dispense with a sheet diverter and nevertheless to separate reject sheets from the good sheets. In this case, this separation of the reject sheets takes place in the deliverer stack, a tab being inserted into the deliverer stack in each case before and after the reject sheet or sheets. Thus, the reject sheets are always located between two inserted tabs and can be separated easily from the good sheets in the deliverer stack.

Other features which are considered as characteristic for the invention are set forth in the appended claims.

Although the invention is illustrated and described herein as embodied in a method for selecting printing materials in a printing press and a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
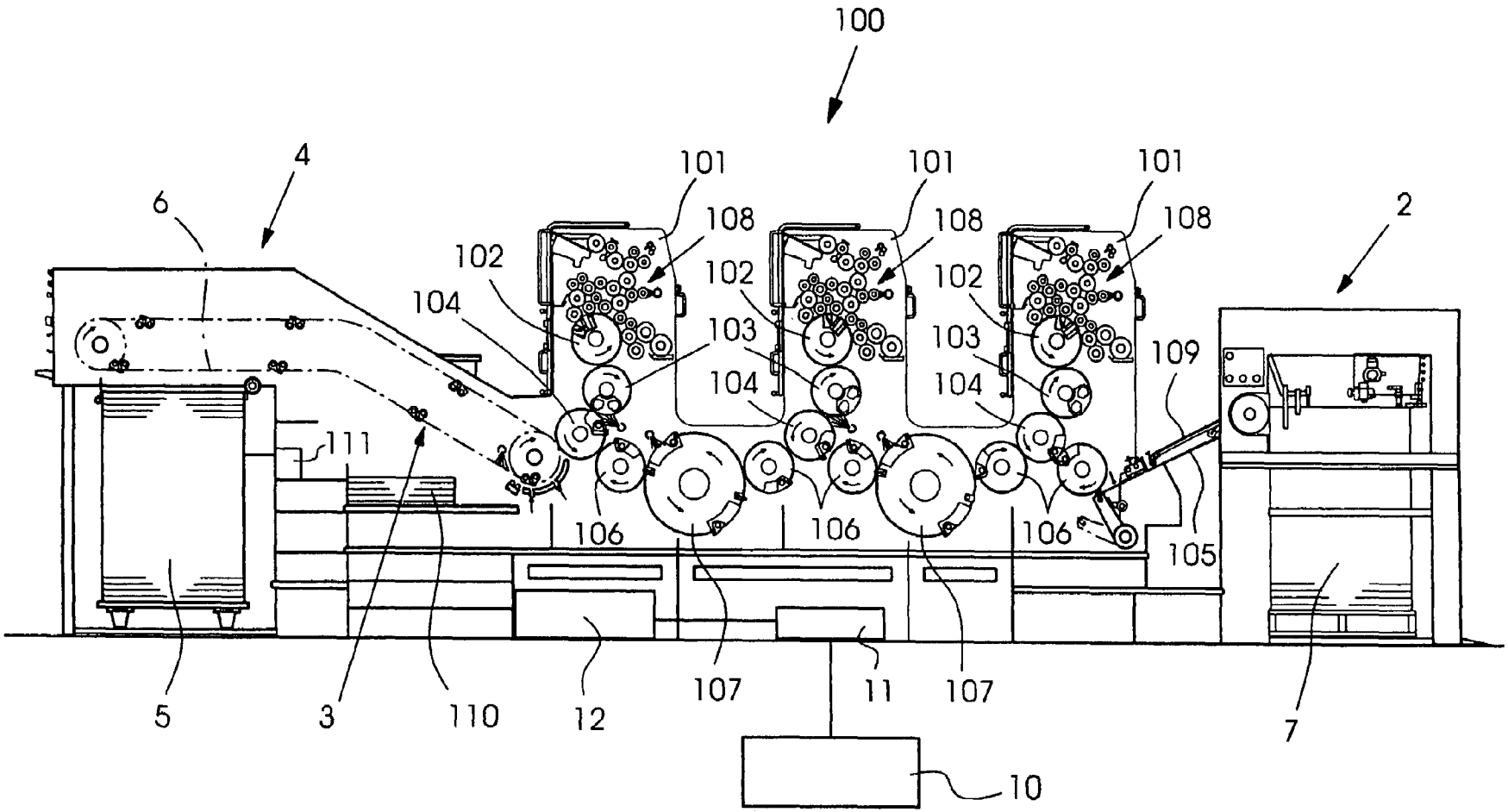
FIG. 1 is a diagrammatic, side view of a sheetfed rotary printing press having a control computer for registering reject sheets according to the invention.

Referring now to the figures of the drawing in detail and first, particularly, to FIG. 1 thereof, there is shown a sheetfed rotary printing press 100 which has a three printing units 101. Each of the three printing units 101 has an inking unit 108 which supplies the cylinders of the respective printing unit 101 with ink and damping solution. From the inking unit 108, the printing ink reaches the plate cylinder 102, which in turn transfers a printing image to a blanket cylinder 103. The blanket cylinder 103 transfers the printing image to a sheet 109 to be printed, which is transported through in the press nip between the blanket cylinder 103 and an impression cylinder 104. This procedure proceeds in each of the printing units 101, so that, as it runs through the printing press 100, the sheet is gradually printed with all the color separations. At the start of the printing press 100, the sheets 109 are removed from a feeder stack 7 and separated in the feeder 2. The separated printing sheets 109 are transferred from the feeder 2 via a feeder suction belt 105 in the first printing unit 101 to a transport cylinder 106. The transport cylinders 106 are used for the purpose of transporting the sheets 109 between the printing units 101. In addition, in FIG. 1, in each case turner drums 107 are disposed between the printing units, so that the sheets 109 can be turned between two successive printing units 101, so that both sides of the sheets can be printed. After leaving the last printing unit 101, the sheets 109 in the deliverer 4 are gripped by a gripper chain 6, which deposits the sheets 109 on the deliverer stack 5. Deliverer stack 5 and feeder stack 7 can be removed from the printing press 100 or newly introduced into the latter by a platform truck or fork lift truck. The deliverer 4 in FIG. 1 additionally offers the possibility of marking specific sheets in the deliverer stack 5 via a tab inserter 111. For this purpose, before a sheet 109 is deposited on the deliverer stack 5, the tab inserter 111 can insert a tab. The same is done following the deposition of one or more sheets 109. In this way, it is possible to identify individual sheets or a plurality of sheets, in particular reject sheets, in the deliverer stack 5 by the inserted tabs protruding laterally. In addition, the printing press in FIG. 1 has a rejects diverter 3, by which sheets 109 can be deposited on a separate rejects stack 110 instead of on the deliverer stack 5. In this case, the sheets 109 are not deposited on the deliverer stack 5 by the gripper chain 6 but are transported a little further until they can be deposited on the rejects stack 110 via the rejects diverter 3.

Both the rejects diverter 3 and the tab inserter 111 are connected to the control computer 10 of the printing press 100 and can be controlled by the computer. In addition, the control computer 10 controls power electronics 11 of the various electric drive motors in the printing press 100. Both the control computer 10 and the power electronics 11 draw their electric power from a power supply 12, which is connected to the public power network. It is therefore clear that mains fluctuations in the public power network can also affect the operating state of the printing press 100 via the power supply 12. However, these fluctuations are registered in the control computer 10 of the printing press 100 and assigned to the corresponding sheets 109 currently being produced. This assignment is made via the internal counter of the printing press, so that the operating conditions during the production of a sheet 109 can be assigned to the latter at any time. In addition to voltage fluctuations in the power network, further operating data such as atmospheric humidity, temperature or adjustment movements in the inking units 108 are registered. The adjustment movements in the inking units 108 are in this case made by electric motors which are able to adjust the individual inking zones; the actuation is likewise carried out via the control computer 10.

Figure 2:
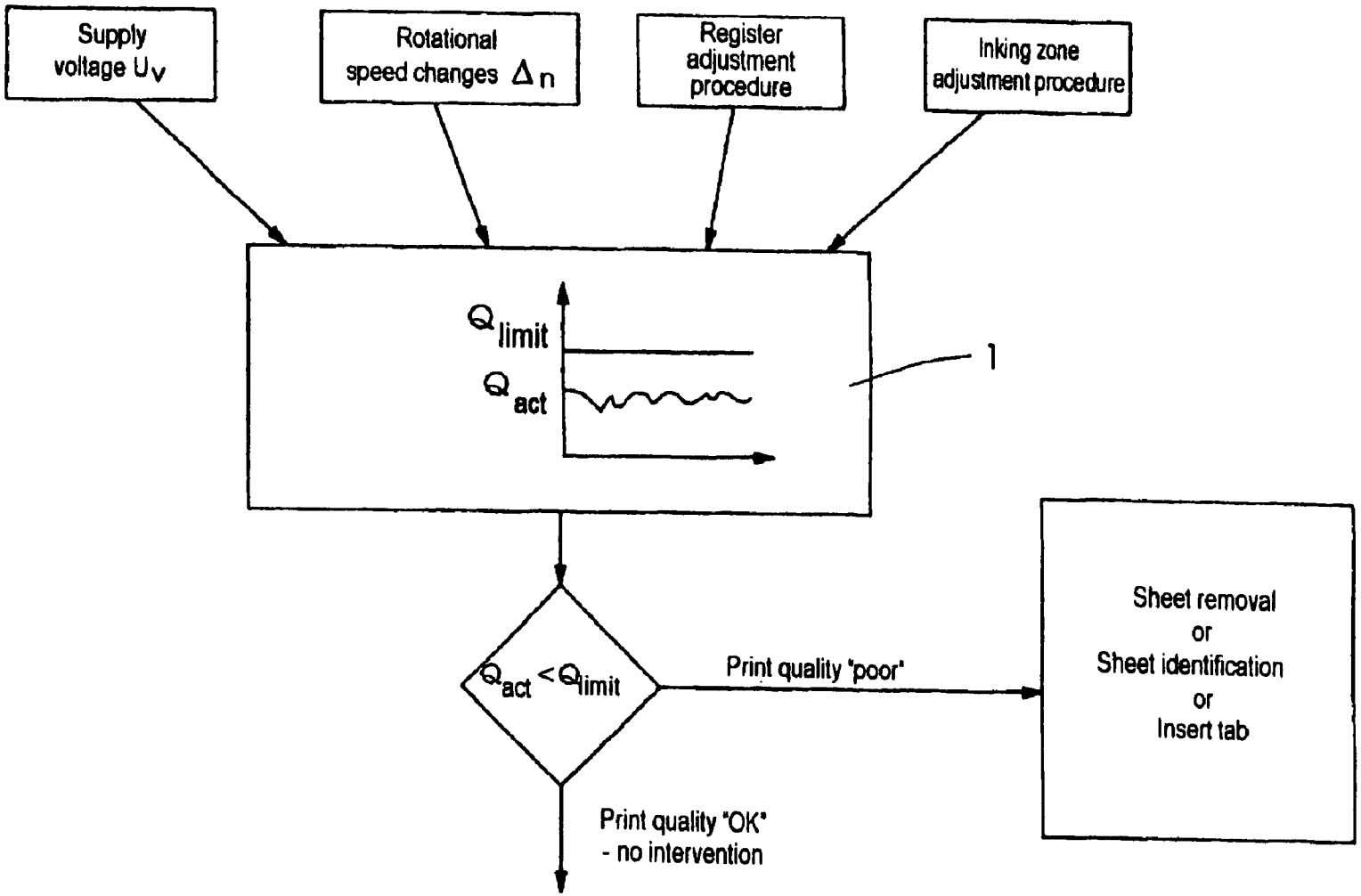
FIG. 2 is a flow charting showing a method for the selection of reject sheets.

FIG. 2 shows the progress of the assessment of operating data during the operation of the printing press 100 in FIG. 1. The assessment of the operating data is in this case carried out by an analytical program 1 in the control computer 10. All the operating data from the printing press 100 is supplied to the analytical program 1. This includes, for example, the supply voltage Uv, rotational speed changes Δv, adjustment procedures on the registers of the printing press 100 and adjustment procedures on the inking zones in the inking units 108. However, the enumeration of the operating data is to be understood as only exemplary and not exhaustive, since further operating data from the printing press 100 can be supplied to the analytical program 1. All the operating data is registered by the analytical program 1 and assessed against stored tolerance limits, individually or in groups. From these individual assessments, the analytical program 1 creates an overall assessment, which ends in the actual current registered print quality $Q_{act}$. The registered print quality $Q_{act}$ is in turn compared with a permissible tolerance limit $Q_{limit}$. If the registered print quality $Q_{act}$ exceeds the permissible tolerance limit $Q_{limit}$, then the print quality $Q_{act}$ is judged to be poor and the sheets 109 produced in the time interval assessed are registered appropriately in the control computer 10.

It is possible to proceed further in various ways with the sheet 109 registered in this way. For example, the reject sheet 109 judged to be poor can be removed via the rejects diverter 3 and deposited on the rejects stack 110. Alternatively, the reject sheets 109 can be deposited on the deliverer stack 5 and marked appropriately by a tab inserter 111 by tabs. In addition, the sheets 109 can also be identified as rejects by applying a marking. In this way, it is possible for the printer to detect without difficulty those sheets 109 during whose production operating disturbances have occurred, which permits conclusions to be drawn with great probability that the printing quality does not correspond to the requirements. Nevertheless, the printer does not simply have to throw these sheets 109 away; he can carry out an additional visual inspection and then, if appropriate, nevertheless pass on the sheets 109 to further processing.

If the registered print quality $Q_{act}$ lies within the permissible tolerance limits $Q_{limit}$, then the associated sheet 109 is judged to be good and it does not need to be registered further by the control computer 10. In this case, the sheet 109 in the deliverer 4 is deposited on the deliverer stack 5 and released for further print processing. As compared with conventional assessment of the print quality by optical sensors, what is known as an "in-line" measuring apparatus in sheetfed offset printing presses, the present invention offers the great advantage that, so to speak, "feedforward" control is carried out. It is not the case that the effects of disturbing influences on the printed image of the sheet 109 are awaited and these are registered by optical sensors and then the corresponding sheets 109 are determined; instead the effects of the disturbing influences on the printed image of a sheet 109 are calculated in advance and the corresponding sheet 109 is then registered at the same time. In this way, it is possible to dispense with an expensive optical "in-line" measuring apparatus and nevertheless to register the print quality of individual sheets 109.

We claim:

1. A method for selecting printing materials in a machine processing the printing materials and having at least one control computer, which comprises the steps of:

logging operating data of the machine processing the printing materials in the control computer;

storing a tolerance limit corresponding to the operating data registered in the computer;

determining if the tolerance limit is exceeded during a time interval; and registering the printing materials produced in the time interval in the control computer if the tolerance limit was exceeded during the time interval.

2. The method according to claim 1, which further comprises registering disturbances occurring in a power supply of the machine processing the printing materials in the control computer.

3. The method according to claim 1, wherein the machine processing the printing materials is a printing press and the method further comprises:

registering printing speed changes in the control computer.

4. The method according to claim 1, wherein the machine processing the printing materials is a printing press and the method further comprises:

registering adjustment procedures performed in an inking unit of the printing press in the control computer.

5. The method according to claim 1, which further comprises evaluating and assessing the operating data by using predefined assessment principles stored in the control computer.

6. The method according to claim 1, which further comprises removing the printing materials produced and registered from the machine processing the printing materials by using a sheet diverter.

7. The method according to claim 6, which further comprises depositing the printing materials removed on a rejects stack.

8. The method according to claim 1, which further comprises providing the printing materials produced and registered by the control computer with a marking.

9. The method according to claim 1, which further comprises separating the printing materials registered by the control computer from further sheet printing materials using a tab inserter.

10. An apparatus, comprising:

a machine processing printing materials;

at least one control computer connected to said machine, said control computer programmed to:

log operating data of said machine processing the printing materials in said control computer;

store a tolerance limit corresponding to the operating data registered in the computer;

determine if the tolerance limit is exceeded during a time interval; and register the printing materials produced in the time interval in said control computer if the tolerance limit was exceeded during the time interval.

11. The apparatus according to claim 10, wherein said machine is a printing press.

* * * * *